United States Patent [19]

Mask

[11] Patent Number: 4,535,985

[45] Date of Patent: Aug. 20, 1985

[54] POWER HIP, HACK SQUAT AND LEG EXERCISE SLED

[76] Inventor: Ernest D. Mask, 311 Marion La., Lee's Summit, Mo. 64063

[21] Appl. No.: 515,302

[22] Filed: Jul. 19, 1983

[51] Int. Cl.[3] ..... A63B 21/00

[52] U.S. Cl. ..... 272/134; 272/117

[58] Field of Search ..... 272/117, 93, 72, 116, 272/118, 143

[56] References Cited

U.S. PATENT DOCUMENTS

| | | | |
|---|---|---|---|
| 1,979,783 | 11/1934 | Williams et al. | 272/72 |
| 3,866,914 | 2/1975 | Jackson | 272/117 |
| 4,316,608 | 2/1982 | Lundberg | 272/117 |

FOREIGN PATENT DOCUMENTS

| | | | |
|---|---|---|---|
| 1124173 | 6/1956 | France | 272/117 |

*Primary Examiner*—Richard J. Apley
*Assistant Examiner*—William R. Browne
*Attorney, Agent, or Firm*—Schmidt, Johnson, Hovey & Williams

[57] ABSTRACT

An adjustable leg exercise device is provided which is easily configured for either a power hip, power leg, or hack squat exercise and is adaptable for safe use by athletes of different size and strength. The exercise device preferably includes a pair of parallel, spaced-apart, upwardly inclined rails each having a lowermost end secured to a floor-engaging base frame. Slidably mounted between the rails is a weight-receiving unit. Advantageously, the uppermost ends of the rails are interconnected by a yieldable structure permitting slight outward diverging movement of the rail upper ends during exercise thereby properly distributing the weight resistance to the athlete. An exercise unit positioning mechanism is included on at least one of the rails to permit adjustment of the starting position of the weight-receiving unit for accommodating various sized athletes. An adjustable bench is provided which is selectively positionable along the base frame from a use position to a stowed position. In the use position, the power hip exercise is easily performed, while the stowed position allows the performance of either the hack squat or power leg exercises. The bench includes a detachable portion which is attachable to the exercise unit for providing back support in the hack squat exercise. Preferably, an adjustable foot support is provided having a narrow plate for supporting the toes in the power leg exercise and a wide plate for supporting the entire foot during the hack squat exercise.

15 Claims, 16 Drawing Figures

10
18
20
26
28
32
34
38
40
42
50
52
54
56
58
60
62
64
66
68
70
72
74
84
86
88
90
92
94
106
110
116
126
128
129
130
132
134
136
138
140
142
146
148
150
152
154
156
158
160
162
168
170
172

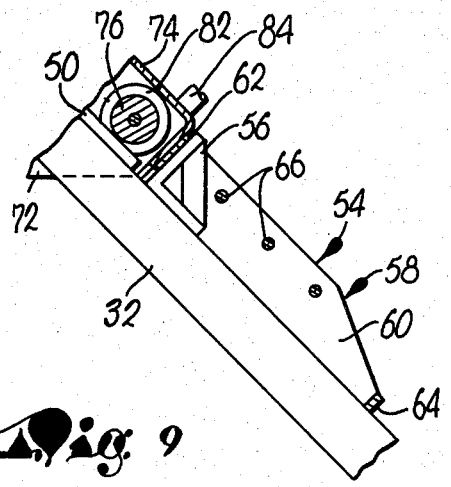
Fig. 9
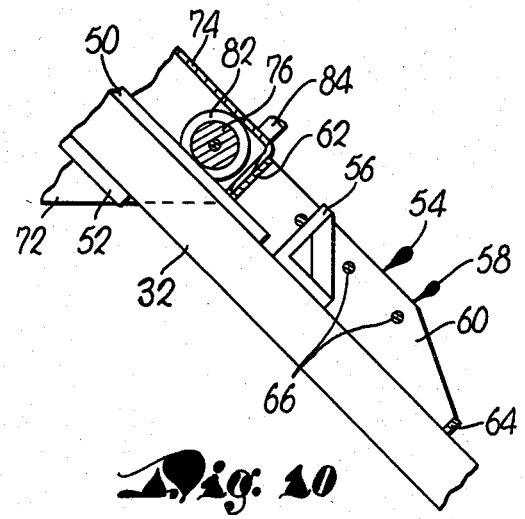
Fig. 10
Fig. 14
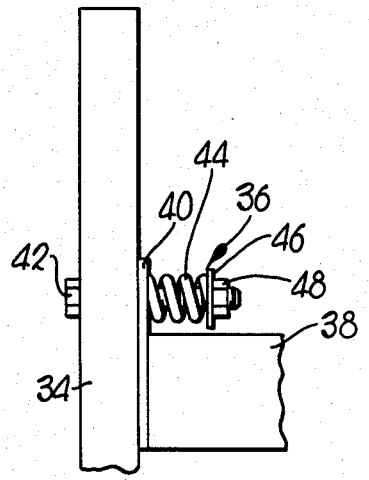
Fig. 15
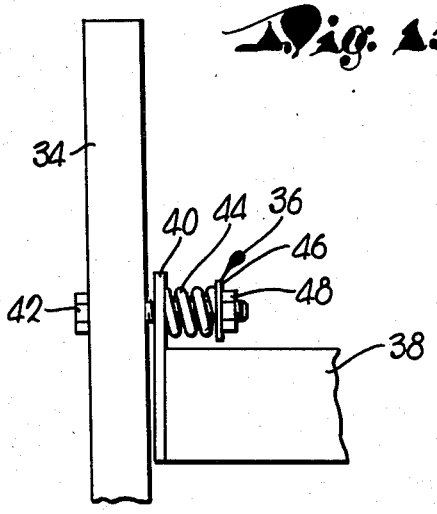
Fig. 16
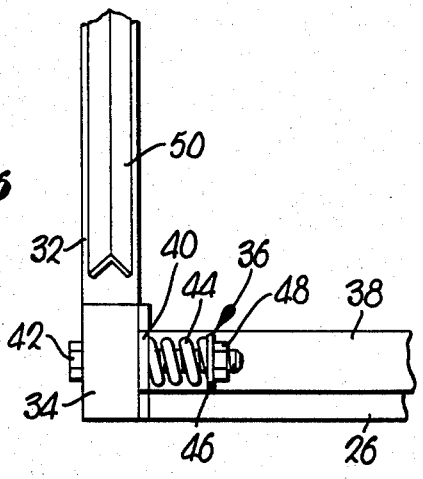
Fig. 13
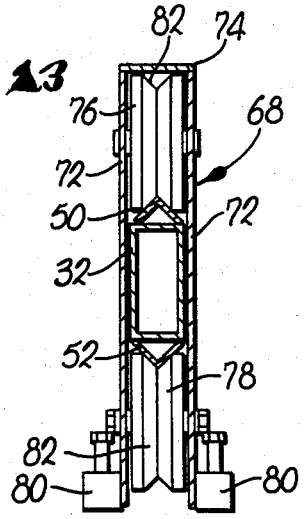

POWER HIP, HACK SQUAT AND LEG EXERCISE SLED

BACKGROUND OF THE INVENTION

1. Field of the Invention

This invention relates to an improved leg exercise device which is easily configured for a variety of leg exercises and is adaptable for safe use by athletes of different size and strength. More particularly, it is concerned with a leg exercise device which incorporates an adjustable foot support, a variable positioning mechanism which adjusts the starting position of the weight-receiving unit, a yieldable frame interconnect which adapts the leg exercise device to athletes having different leg strengths, and a separable, adjustable bench which is easily configured for the desired exercise.

2. Description of the Prior Art

Exercise in general and weight lifting in particular has enjoyed a surge in popularity in recent years. Today, weight lifting is enjoyed by a wide variety of people in fitness centers, athletic programs, and strength and conditioning programs. In its infancy, such weight lifting programs typically used conventional free-weight barbells with the athlete using a variety of stances, or sometimes utilizing a specially configured support bench. Today, however, weight lifting programs have developed to a highly sophisticated state in which relatively complex devices are employed to enable the athlete to address and strengthen a particular muscle group.

This trend has led to the development of a number of leg exercise devices which are a substantial improvement over using barbell free weights to strengthen and condition the leg muscles. More recently, several leg exercise devices have been proposed which are adaptable for a variety of leg exercises. Typically, such devices have employed a floor-engaging frame, a pair of parallel, upwardly inclined rails fixedly secured to the frame, and a weight-receiving unit slidably mounted between the rails. With such a machine, a bench can be positioned at the base of the rails so that an athlete can lay in a supine position upon the bench, with his feet engaging the weight-receiving unit, and perform a leg press or power hip exercise by sliding the weight-receiving unit up the rails. In such a power hip exercise, substantially the same muscle groups are exercised as in a free weight squat utilizing traditional barbells, but the use of such a device substantially reduces stress on the lower back of an athlete thereby decreasing injury potential. Some of these leg exercise devices have been adaptable for removal of the bench and have incorporated shoulder-engaging pads on the weight-receiving unit. In such a configuration, the athlete may assume an anterior position (facing away from the weight-receiving unit) the athlete can perform a hack squat exercise, which is particularly useful in isolating and developing the quadricep muscles. In a posterior position (athlete facing the weight-receiving unit), and perform a power leg exercise, which is particularly useful in developing explosive leg power.

While such leg exercise devices have proven useful in many respect, a significant number of problems remain with such devices. For example, such devices have typically not incorporated structure for optimally supporting the feet of the athlete for both the hack squat exercise and the power leg exercise. As those skilled in the art will appreciate, it is important to properly support the balls of the feet of an athlete in the power leg exercise to achieve optimal conditioning of the calf muscles and achilles development. However, in the hack squat exercise, it is important that the entire foot of the athlete be supported and properly positioned to better isolate the quadricep muscles. A further problem associated with such past devices has been the inability to adjust the starting position of the weight-receiving unit upon the rails. Thus, it has been difficult to properly position the athlete upon such devices simply because such devices were not easily adaptable to various size and strengths of athletes.

Another problem sometimes encountered with such past leg exercise devices has been the binding or canting of the leg exercise unit as it slides up the rails. Particularly in rehabilitation programs, where one leg is weaker than the other leg, it is often difficult for an athlete to properly position his legs, particularly in the power hip exercise, where the leg exercise unit will slide without binding upon the rails. Still another difficulty associated with some past exercise devices is the positioning of the weights upon the weight-receiving unit. Typically such devices have incorporated one or more steel shafts secured to the weight-receiving unit for the sliding reception of the amount of free weights desired for the exercise. As can be appreciated, these shafts must be oriented upon the weight-receiving unit so that the free weights will not come off during exercise, even if the weight-receiving unit is suddenly released during exercise. For safety reasons, it is important that the steel shafts be oriented for retaining the free weights, however, sometimes the necessary orientation makes it very difficult to easily and quickly add or remove free weights.

A final problem often associated with such past leg exercise devices is their inability to easily be configured to provide adequate back support for both the hack squat exercise and the power hip exercise. As outlined above, it is desirable to provide back support during the power hip exercise to lessen the possibility of back stress during the exercise. Further, in the hack squat exercise, with the athlete in the anterior position, it is desirable to provide back support to the athlete. To provide back support in the hack squat exercise, it is necessary to incorporate the back support in the weight-receiving unit. A few of the past leg exercise devices have incorporated a permanent back support in the weight-receiving unit, however, such a built-in back support is undesirable for the power hip or power leg exercises. Further, such back supports have proven inadequate in providing the necessary support while nevertheless, making the weight-receiving unit cumbersome.

SUMMARY OF THE INVENTION

The problems outlined above associated with such past leg exercise devices are in large measure solved by the improved leg exercise device of the present invention. That is, the device hereof provides for an adjustable foot support structure for optimally supporting the feet for either the hack squat exercise or the power leg exercise and includes a variable positioning mechanism by which the starting position of the weight-receiving unit can be adjusted for various size athletes. Structure is provided for yieldably interconnecting the uppermost ends of each of the rails, for preventing the binding problems of the weight-receiving unit associated with past devices. Further, safety of the present invention is enhanced by the inclusion therein of weight retention lugs incorporated as a component of the weight-receiving shafts. Advantageously, a removable bench portion and attachment structure is provided whereby the bench is optimally positionable for the power hip exercise or the hack squat exercise, and quickly removable when desired.

The leg exercise device of the present invention broadly includes an elongated, floor-engaging base having a pair of generally parallel frame members, a pair of elongated generally parallel, upwardly inclined rails each having a lowermost end affixed to a respective frame member, an elongated cross beam yieldably interconnected between the upper ends of the rails in such a manner to permit slight lateral movement between the rail upper ends, a weightreceiving unit slidably mounted between the rails, a unit positioning mechanism on one of the rails for adjusting the position of the weight-receiving unit upon the rails, and a flat bench having a removable portion which includes structure for selectively and operably attaching the removable portion to the weight-receiving unit. Preferably, the unit positioning mechanism includes an upwardly extending stop secured to the rail, an elongated block presenting a contact face at one end thereof, and structure defining a plurality of generally parallel openings extending through the block in such a manner for alternately receiving the stop whereby the block can be selectively positioned atop the rail. Preferably the bench includes structure for adjustably securing the bench between the frame members of the base for selective shifting the bench along the length of the frrame. Thus, the bench can be secured in place for the power hip exercise or displaced for the hack squat and power leg exercises. Advantageously, the unit positioning mechanism, adjustable bench, and laterally movable rail upper ends cooperate to accommodate various size athletes, serve to compensate for strength differences between the legs of an athlete, and allow for a single leg exercise device to be easily configured for at least three leg exercises.

In particularly preferred forms, an adjustable foot support is provided which includes an elongated support beam, a first member having an elongated, flattened, first plate transversely oriented to the beam with structure for adjustably securing the first member along the length of the beam. An elongated, flattened second member is included, having a transverse dimension greater than the first plate and structure is presented for mounting the second member for selectively alternatingly engaging the first member. Preferably, the mounting structure is such that the first plate and second member are pivotally coupled adjacent respective lowermost margins thereof.

In preferred forms, a weight retention safety device is included on the weight-receiving bars of the weight-receiving unit. The device includes a weight retention lug presenting an elongated first portion secured to the axial face of the respective bar, with the first portion extending generally parallel to the longitudinal axis of the bar. An elongated, upwardly oriented second portion is transversely secured to the first portion, and preferably, the second portion extends radially outward beyond the outermost lineal dimensions of the perimeter of the bar.

BRIEF DESCRIPTION OF THE DRAWING

FIG. 9 is a fragmentary vertical sectional view illustrating the unit positioning mechanism in a first position;

FIG. 10 is a fragmentary vertical sectional view similar to FIG. 9 illustrating the unit positioning mechanism in a second position;

FIG. 13 is a vertical sectional view depicting the preferred mounting structure of the weight-receiving unit to a respective rail;

FIG. 14 is a fragmentary elevational view illustrating the yieldable interconnect structure for connecting the cross beam between the upper ends of the respective rails, particularly illustrating the relative positions when the rails are generally parallel;

FIG. 15 is a fragmentary elevational view similar to FIG. 14 illustrating the relative position of the components when the rail upper ends slightly diverge; and FIG. 16 is a fragmentary view in plan of the interconnection between one end of the cross beam and the upper end of one of the rails.

DESCRIPTION OF THE PREFERRED EMBODIMENT

Figure 1:
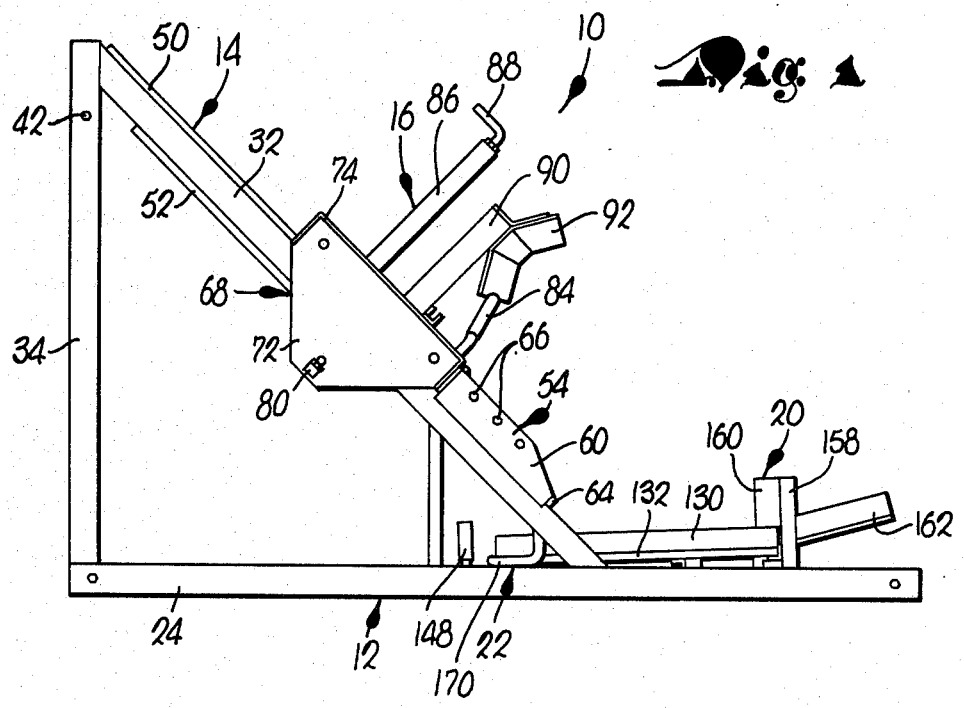
FIG. 1 is a side elevational view of the preferred leg exercise device of the present invention configured for the power hip exercise.

Referring now to the drawing, an improved leg exercise device 10 in accordance with the present invention broadly includes a floor-engaging, rectangularly-shaped in plan, base frame 12, an upstanding rail support structure 14 secured to the base frame 12, a weight-receiving unit 16 operatively mounted to the rail support structure 14, an adjustable foot support 18 operatively mounted to the base frame 12, and an adjustable bench broadly denoted by the numeral 20 and operatively coupled to the base frame 12 for selective movement thereon between a stowed position and a use position. Advantageously, the bench 20 includes an elongated removable portion 22 which, when detached from the bench 20 can be attached to the weight-receiving unit 16 if desired.

Figure 5:
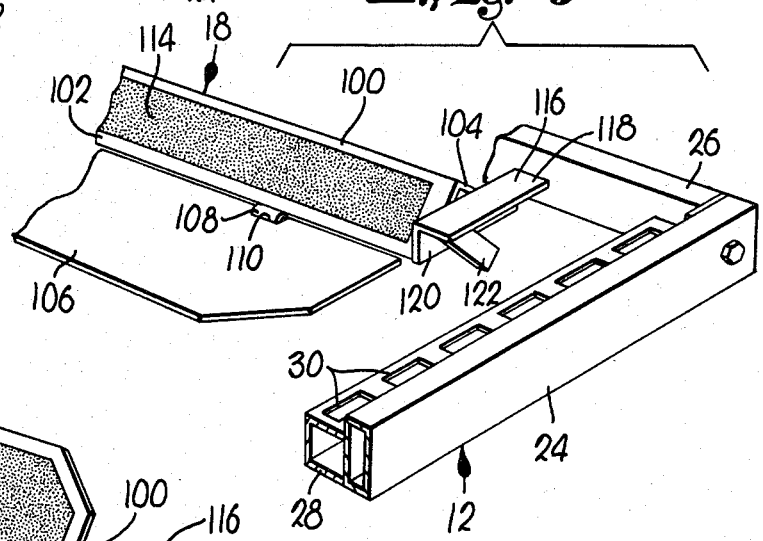
FIG. 5 is a fragmentary, partially exploded perspective view of portions of the adjustable foot support and base frame of the present invention with the foot support configured for the power leg exercise.

In more detail, the base frame 12 presents a pair of parallel, spaced-apart tubular, rectangular in cross-section side frame members 24 interconnected at respective distal ends thereof by a pair of rectangular in cross-section, tubular elongated base frame members 26. The base frame members 26 present an apertured flange as at 25 and the side frame members 24 complementally apertured for the orthogonal securement of members 24, 26 by the nut and bolt combination as at 27 (see FIGS. 3 and 5). Thus, the respective members 24, 26 are interconnected to present a rigid, rectangular in plan support frame. As seen in FIG. 5, each side frame member 24 includes an elongated, tubular, rectangular in cross-section channel frame member 28 affixed to the interior face thereof (as by welding). The uppermost face of each channel frame member 28 presents structure defining a plurality of elongated, spaced-apart slots 30 extending therethrough.

Figure 2:
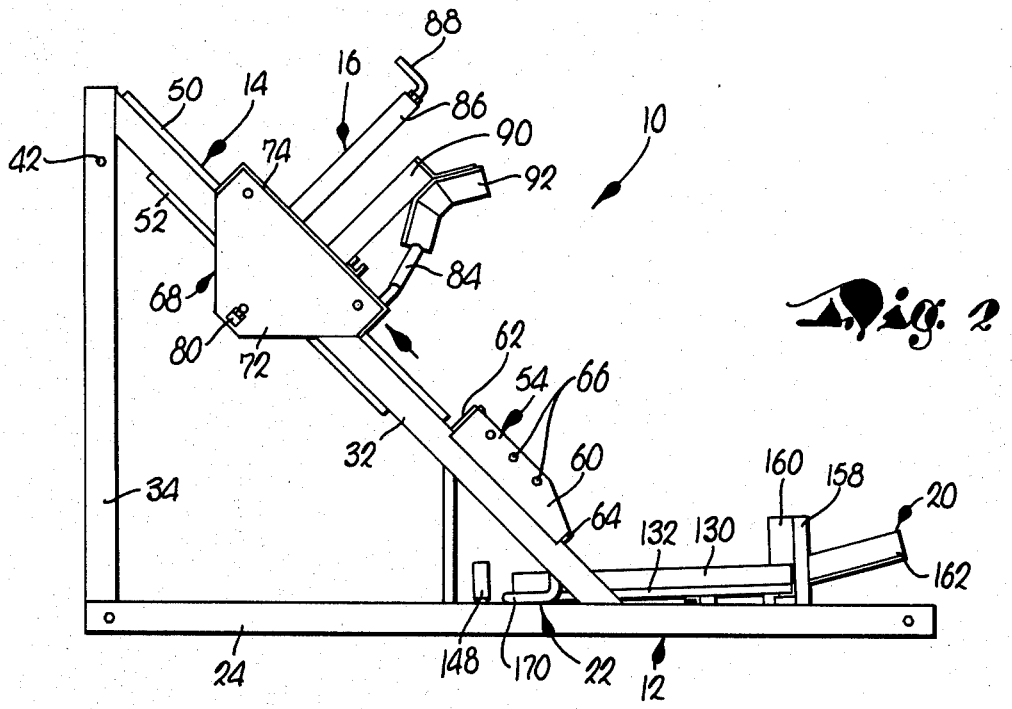
FIG. 2 is an elevational view similar to FIG. 1 particularly illustrating the relative movement of the weight-receiving unit of the present invention during exercise.
Figures 3, 8:
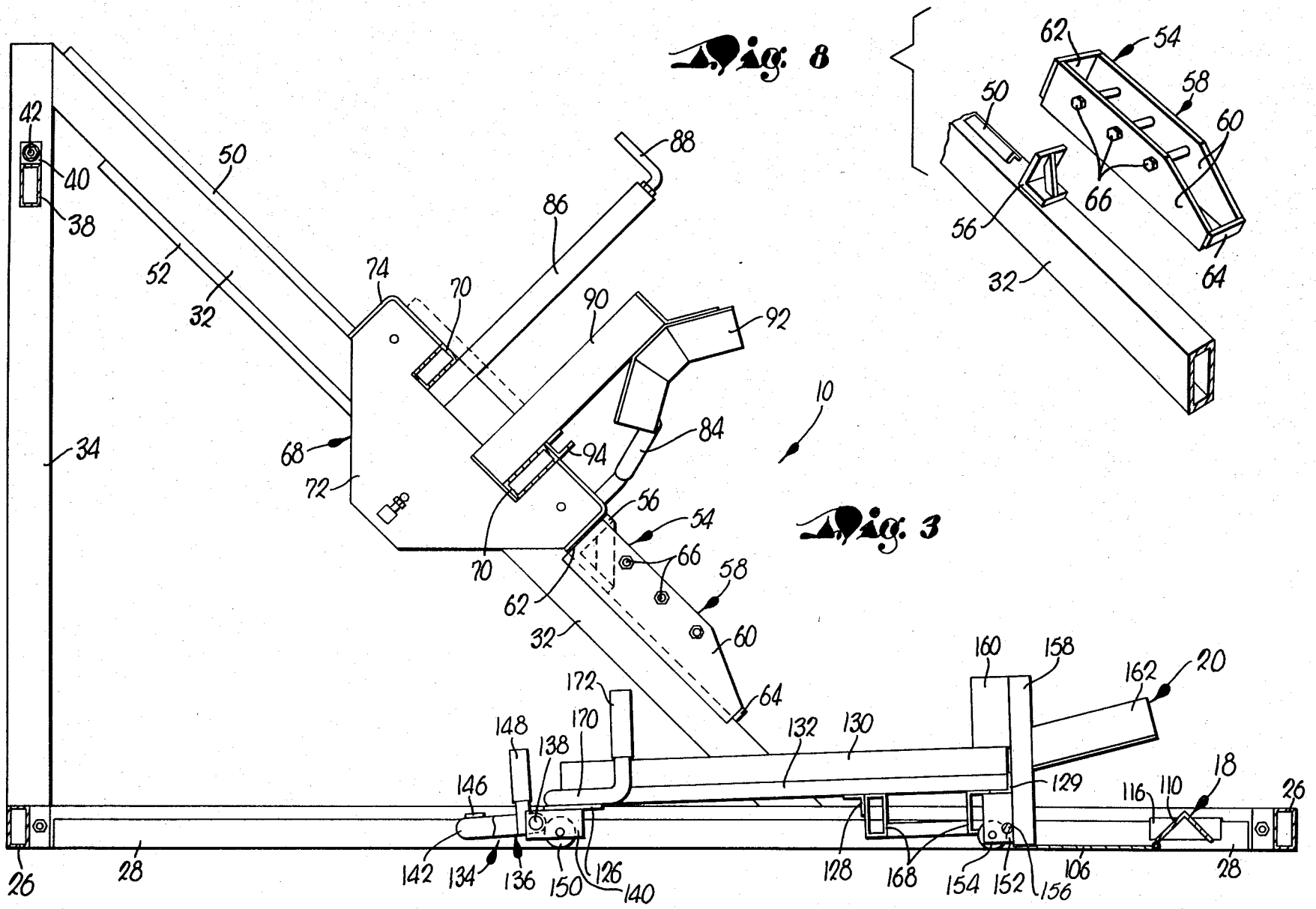
FIG. 3 is a vertical sectional view of the present invention configured for the power hip exercise and depicting in phantom details of construction of the unit positioning mechanism.
FIG. 8 is a fragmentary perspective view particularly illustrating the unit positioning mechanism of the present invention.

The rail support structure 14 includes a pair of upstanding, obliquely-oriented, rectangular in cross-section elongated rails 32, with the lowermost end of each rail affixed to respective side frame member 24 as by welding (see FIG. 1). Affixed to, and depending from, the uppermost end of each rail 32 is an elongated, rectangular in cross-section upright member 34. As shown in FIGS. 1–3, each upright member 34 is affixed at the uppermost end to respective rail 32, while the lowermost end of member 34 is affixed to the respective side frame 24. Advantageously, the upright members 34 are interconnected adjacent their uppermost ends by a yieldable interconnecting structure 36. The structure 36 includes an elongated cross beam 38 presenting an outwardly extending flange plate 40 affixed at each distal end thereof. Each flange plate 40 and the respective upright member 34 are complementally apertured for the operable reception of an elongated bolt 42 as seen in FIGS. 14–16. With the flange plate 40 adjoining the respective upright member 34, a compression spring 44 is received on the bolt 42 and held in place by the retaining washer 46 and nut 48.

As can be appreciated, the member 34 and rail 32 are fixedly secured so that the yieldable interconnecting structure 36 operates to interconnect the upper ends of rails 32. Each rail 32 additionally presents a pair of elongated, L-shaped in cross-section angle channels 50, 52 respectively affixed to the upper and lower faces of each rail 32, as by welding (see e.g., FIGS. 2, 13).

In the preferred embodiment, each rail 32 presents a unit positioning mechanism 54 mounted on the uppermost face thereof. To this end, an L-shaped in cross-section support stop 56 is secured to the upper face of the respective rail 32 (as by welding). An adjustable block 58 is operatively mounted on each stop 56 and includes a pair of side plates 60 interconnected at the uppermost end by a resilient surfaced contact plate 62 and at the lowermost end by brace plate 64. Interconnecting the side plates 60 intermediate the plates 62, 64 are three spaced-apart elongated machine bolts 66 as shown in FIG. 8. As shown in FIGS. 3, 9, and 10, each block 58 is adjustably positionable atop the respective rail 32 with the lowermost margins of each side plate 60 partially engaging the rail 32. The stop 56 is received within the block 58 so as to engage either the contact plate 62 or any of the respective machine bolts 66, as desired.

Figure 4:
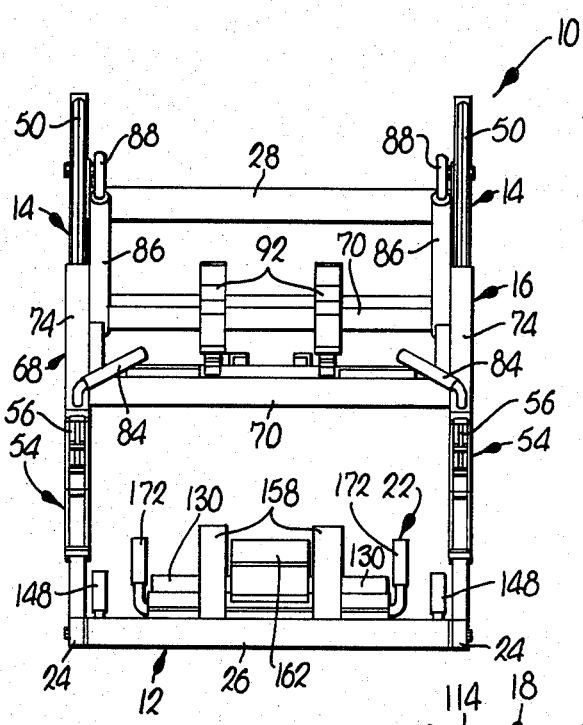
FIG. 4 is a front elevational view of the present invention.
Figure 12:
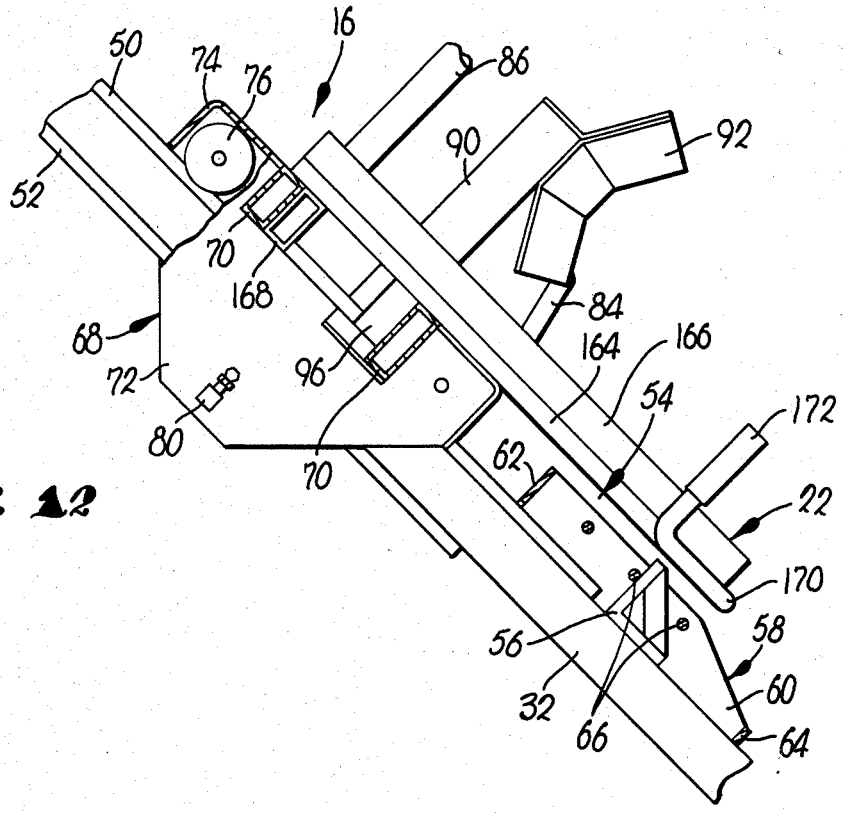
FIG. 12 is a fragmentary vertical sectional view depicting the connection of the removable bench portion to the weight-receiving unit with parts broken away for clarity.

The weight-receiving unit 16 includes a pair of slidable connection units 68 respectively operatively coupled to a respective rail 32, with the connection units 68 interconnected by a pair of elongated, parallel, spaced-apart rectangular in cross-section cross beams 70 (see FIG. 4). Each slidable connection unit 68 presents a pair of trapezoidal-shaped, opposed support plates 72 (see FIGS. 3, 13) interconnected along the uppermost margins thereof by a U-shaped casing 74 (see FIG. 12). A pair of uppermost rollers 76 are secured between the support plates 72 (using an axle inserted through complementally aligned apertures in plates 72) as shown in FIGS. 12, 13. Similarly, a lower roller 78 is secured between each support plate 72, but is adjustably disposed by the set screw adjustment structures 80 affixed to each support plate 72. As seen in FIG. 13, rollers 76, 78 include a V-shaped guide channel 82 circumferentially inscribed therein so that with the slidable connection unit 68 positioned on the rail 32, the upper rollers 76 operatively engage the upper angle channel 50 while the lower roller 78 operatively engages the lower angle channel 52.

Each slidable unit 68 additionally includes an inwardly oriented, support handle 84 affixed to the upper casing 74 (FIG. 4). An elongated, cylindrical, upwardly oriented weight-receiving bar 86 is secured to each slidable connection unit 68. An L-shaped weight retention lug 88 is affixed to the uppermost axial face of each bar 86 for purposes which will be made clear.

Turning to FIGS. 3–4, it is seen that the lowermost cross beam 70 has medially affixed thereto a pair of spaced-apart upstanding brace elements 90 each presenting a shoulder pad 92 affixed thereto. A pair of flattened extension plates 94 are affixed to the lower cross beam 70 just slightly outboard of the brace elements 90. Inboard of the brace elements 90 lowermost cross beam 70 presents a pair of inwardly oriented angle irons 96 secured thereto, as by welding.

Figure 6:
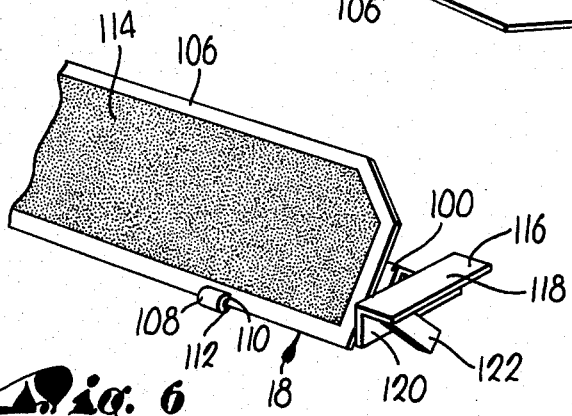
FIG. 6 is a fragmentary perspective view of a portion of the adjustable foot support in the hack squat exercise position.
Figure 7:
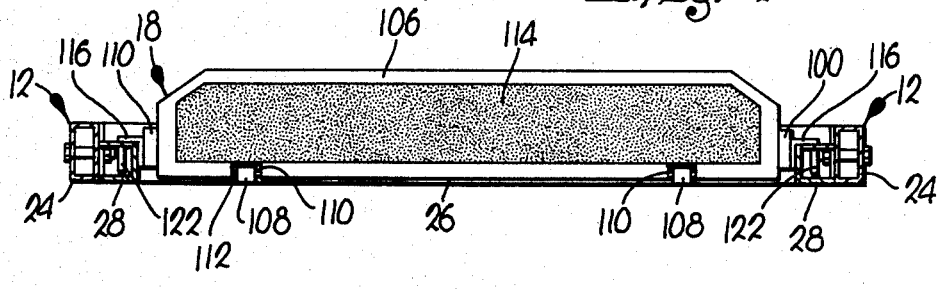
FIG. 7 is a vertical sectional view illustrating the adjustable foot support of the present invention when configured for the hack squat exercise.

Turning now to FIGS. 5–7, the adjustable foot support 18 of the device 10 is illustrated. Advantageously, the foot support 18 is operatively adjustable along the length of base frame 12 between respective side frame members 24. The adjustable foot support 18 includes an elongated first member 100 presenting a pair of flattened, rectangularly-shaped first and second plates 102, 104 weldingly secured along respective medial margins thereof in an orthogonal configuration to present an upwardly gabeled L-shaped cross-section. An elongated flattened second member 106 is pivotally coupled to the first member 100, and to this end, first plate 102 has a pair of spaced-apart journals 108 welded adjacent the lowermost margin thereof (see FIG. 7). Complementally, the lowermost margin of second member 106 presents a pair of spaced-apart cutouts 110 each containing an axle 112; each axle 112 is operatively received in the respective journal 108. This pivotal coupling of the second member 106 to the first member 100 allows the second member 106 to be articulated from a non-use position as seen in FIG. 5 to a use position as seen in FIGS. 6–7. Further, the outer operative surfaces of the first plate 102 and second member 106 have anti-skid surfaces 114 imposed thereon. Secured to each distal end of the first member 100 is an adjustable securement structure 116 (as by welding). The securement structure 116 presents a pair of flattened plates 118, 120 orthogonally adjoined along respective lateral margins thereof.

In this regard, the lower plate 120 is transversely secured to the first member 100 with the upper plate 118 presenting an obliquely-oriented depending arm 122 secured to the lowermost face thereof.

Figure 11:
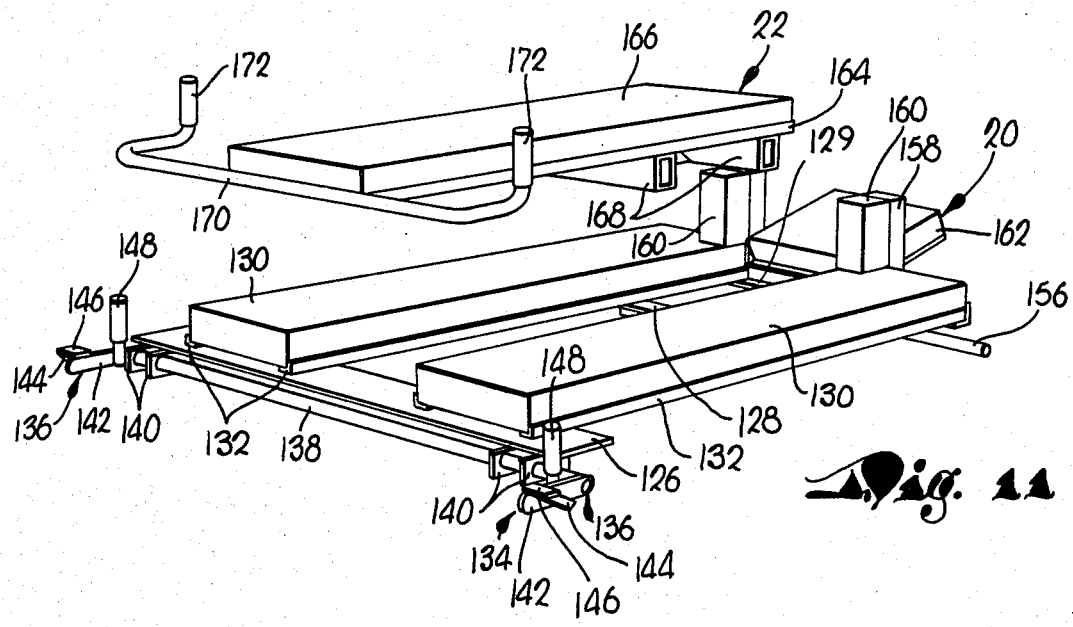
FIG. 11 is a partially exploded, perspective view of the bench of the present invention particularly illustrating the removable portion of the bench.

Turning now to FIGS. 3, 11, the adjustable bench 20 and bench removable portion 22 are shown in some detail. The bench 20 includes as support framework a flattened support plate 126 at one end (the bottom end) of bench 20 and a pair of spaced-apart elongated support angle irons 128, 129 oriented as shown in FIG. 3 and disposed towards the other (the head end) of bench 20. A pair of elongated, spaced-apart back pads 130 are transversely affixed between the plate 126 and angle irons 128, 129 and to this end, each back pad 130 includes an elongated L-shaped in cross-section support channel 132 affixed over the lowermost corner margins of each pad 130 for attachment purposes. Secured beneath the support plate 126 at the bottom end of bench 20 is a locking mechanism broadly denoted as 134. Locking mechanism 134 includes a pair of latching structures 136 interconnected by an elongated, cylindrical axle 138. As seen in FIG. 11, each latching structure 136 includes a pair of spaced-apart plates 140 secured to the plate 126, with each plate 140 apertured for the sliding reception of the axle 138. Each latching structure 136 further includes an elongated lever 142 radially secured to the distal end of axle 138, with the lever 142 presenting a depending obliquely-oriented elongated arm 144. A flattened, plate-like adjustment grip 146 is secured to the lever 142 adjacent the arm 144, while an upwardly oriented handle 148 is secured to the lever 142 adjacent the axle 138. As seen in FIG. 3, a pair of rollers 150 are advantageously included for support and are positioned between the respective plates 140 slightly spaced from the axle 138.

Turning to the head portion of the bench 20, as seen in FIG. 3, four plates 152 are affixed to the end support angle iron 129. The plates 152 are grouped in pairs for the similar operative reception of two rollers 154. Adjacent the rollers 154, a pair of elongated cylindrical guide axles 156 extend through the respective plates 152 each having one end secured to the respective plates 152 and the other end extending outboard to adjoin the respective channel frame member 128. A pair of upright, elongated, spaced-apart rectangular in cross-section shoulder supports 158 are transversely affixed to the end support angle iron 129 (see FIGS. 3, 11) and each shoulder support 158 includes a resilient cushion 160 affixed thereto. Intermediate the shoulder supports 158, a head support 162, including a padded upper surface, is secured in a slight upward orientation relative back pads 130.

The bench removable portion 22, illustrated in FIG. 11 removed from the bench 20, includes an elongated rectangularly-shaped support surface 164 having a similarly shaped resilient cushion 166 affixed to the upper surface thereof. Towards one end of the support surface 164 is transversely affixed a pair of elongated, spaced-apart, rectangular in cross-section tubular cross beams 168. Transversely secured to the other end of the support surface 164 is an elongated U-shaped arm 170 having a pair of upturned handles 172 secured to each end. As seen in FIG. 3 with the bench removable portion 22 coupled to the bench 20, the cushion 166 lies intermediate the back pads 130, arm 170 rests on the plate 126 with the handles 172 outboard of the respective back pads 130, and the cross beams 168 are complementally spaced apart to engage the respective support angle irons 128, 129 of the bench 20.

In operation, the device 10 is adjustable between the power hip, power leg and hack squat exercise positions. For the power hip exercise, the athlete lies in a supine position on the bench 20 with the athlete's head resting on the head rest 162, the athlete's hands grasping handles 172, the athlete's shoulders abutting the shoulder supports cushions 160, and the athlete's legs braced against the lowermost cross beam 70 of the weight-receiving unit 16. For exercise, the athlete presses on the weight-receiving unit 16 as shown in FIGS. 1–2 imparting a sliding movement to the unit 16 up the rails 32. The yieldable interconnect 36 between the upper ends of the rails 32 allows for improved operation in the event the unit 16 is not precisely linearly directed up the rails 32. That is, if one of the athlete's leg is slightly stronger than the other leg (as is often the case in rehabilitation programs) or when the athlete's feet are not evenly spaced on the cross beam 70, the unit 16 may not be exactly perpendicularly oriented during exercise between each rail 32. The yieldable interconnect structure 36 allows the rails to diverge slightly outward, thereby preventing binding of the unit 16 as it travels up the rails 32.

As can be appreciated viewing FIGS. 12–13, the engagement of the rollers 76 to the respective channels 50, 32 allows the weight-receiving unit 16 to be easily directed up the rails 32. This reduction in frictional force permits the athlete to precisely regulate the exercise by adding or subtracting conventional free weights fromo the unit 16 by insertion onto respective bars 86. Further, the adjustment structures 80 coupled to the bottom roller 78, not only facilitate assembly, but also aid in maintaining the proper position of the unit 16 on the rails 32.

The device 10 allows a great deal of flexibility in properly positioning the body for the power hip exercise which, as can be appreciated, is important in optimizing the value and conditioning of the exercise. Thus, the bench 20 is adjustable along the base frame 12 to the desired position by raising the levers 142 of the locking mechanism 134 and sliding the bench 20 on the rollers 150, 154 to the desired position. Once the bench 20 is in position, the levers 142 are released and the depending arms 144 are received in slots 30 of the respective channel frame members 128. As seen in FIG. 3, for the power hip exercise, the adjustable foot support 18 is stowed out of the way for positioning of the bench 20. As athletes can appreciate, the handles 172 and the shoulder supports 158 provide proper body positioning and support for the power hip exercise. Further, the unit positioning mechanisms 54 mounted on each rail 32 are advantageous in varying the starting position for the weight-receiving unit 16. To this end (see FIGS. 8–10), the adjustment block 58 can be positioned atop the support stop 56 as desired. This ability to independently vary the position of both the bench 20 and the weight-receiving unit 16 is advantageous in adapting the device 10 to various sized athletes while maintaining the optimum exercises position.

Converting the device 10 to the power leg exercise configuration or the hack squat exercise configuration is a quick and easy task. To convert the device to the power leg exercise position, lock mechanism 134 is decoupled from the channel frame member 28 and the bench 20 stowed out of the way by sliding the bench 20 towards the upright members 34. With the bench 20 out of the way, the adjustable foot support 18 is positioned as desired with the depending arms 122 received in the appropriate slots 30 in the channel frame members 128. For the power leg exercise, the second member 106 is lowered to the non-use position as shown in FIG. 5. To exercise, the athlete mounts the device in a posterior position (facing towards unit 16), with the balls of his feet placed on the first plate 102, the athlete's shoulders abutting the shoulder pads 92, and the athlete's hands grasping the handles 84. The power leg exercise entails starting from a semi-crouched position and fully extending the body, thereby driving the unit 16 up the rails 32.

To place the device 10 in the hack squat exercise position, only minor adjustment is needed from the power leg position. First, the adjustable foot support 18 is positioned as desired and the second member 106 is pivoted to the use position as shown in FIGS. 6–7. Next, the removable bench portion 22 is removed from the bench 20 (see FIG. 11) and coupled to the weight-receiving unit 16. To properly position the removable bench portion 22, the cross beams 168 are slid between the respective cross beams 70, with the beams 168, 70 complementally dimensioned for abutting engagement as shown in FIG. 12. Additionally, as seen in FIGS. 4, 12, support angle irons 96 are provided and engage the lowermost cross beam 168 of the removable bench portion 22 when the bench portion 122 is attached to the unit 16 for the hack squat exercise.

The athlete assumes the hack squat exercise position by standing on the second member 106 in an anterior orientation (facing away from unit 16) with the athlete's shoulders abutting the shoulder pads 92. The back of the athlete is advantageously supported by the removable bench portion 22, the arm 170 providing a convenient location for the athlete to grasp during exercise. Starting from a semi-crouched position, the athlete extends his legs driving the exercise unit up the rails 32. The adjustment features of the foot support 18 and the unit positioning mechanism 54 allow a great deal of latitude in properly positioning the athlete for exercise.

As can be appreciated, the resistance of the exercise unit 16 to movement up the rails 32 is varied by adding or removing conventional free weights from the bars 86. The problem has existed in the past with properly positioning the bars 86 to securely retain the weights thereon, particularly when a great amount of weight is added. As those skilled in the art will appreciate, if a large amount of weights are positioned on the bars 86 and the unit 16 suddenly released (by accident or on purpose) an unsafe condition exists because of the possibility of the weights bouncing off the bars 86 and onto the athlete or the device 10. Making the bars 86 of greater length would provide a partial solution, however this makes it very difficult to add weights when desired. Therefore, the present invention includes a retention lug 88 upwardly angled as shown in FIGS. 1–3 which effectively safely retains the weights on the bars 86 in all conditions, while still allowing for ease of weight loading.

I claim:

1. A leg exercise device adaptable to various sized athletes and operable from either a supine or squating position, said device comprising:

an elongated, floor-engaging base having a pair of elongated, spaced-apart, generally parallel frame members;

a pair of elongated, spaced-apart, generally parallel, upwardly inclined rails each having one end affixed to a respective frame member;

an elongated cross beam located between and in generally spanning relationship to said rails;

means mounting said cross beam between said rails and adjacent the ends of said rails remote from said frame members for permitting slight lateral movement of said rails;

an elongated weight-receiving unit transversely oriented relative to said rails, means adjacent each end of said unit for slidably mounting said unit on said pair of rails;

a unit positioning mechanism mounted on at least one said pair of rails proximate to the end thereof, said mechanism including an upwardly extending stop secured to of said pair of rails one rail, an elongated block movably disposed atop said one rail and presenting a contact face at one end thereof, and structure defining a plurality of openings in said block along the length thereof for alternately receiving said stop whereby said block can be selectively positioned along one rail of said pair of rails by the selective reception of said stop in one of said openings, thereby adjustably positioning said block contact face atop said one of said pair of rails for abutting engagement with said weight-receiving unit;

a flat bench located generally between said frame members; and means adjustably securing said bench between said frame members for selective shifting of the bench along the length of said frame members, said bench being shiftable from a normal power hip exercise position supporting the athlete in supine disposition with the athlete's feet raised and engaging the weight-receiving unit, to a stowed location allowing the athlete to assume power leg or hack squat exercise positions, said bench having an elongated, flattened, removable portion including means adjacent one end of said portion for selectively and operably attaching said portion to said weight-receiving unit and for supporting the athlete in the hack squat exercise position, said unit positioning mechanism and said adjustable bench thereby cooperating for selective accommodation of various sized athletes in either the supine or squating position and said laterally movable rail other ends serving to compensate for strength differences between the respective legs of a user.

2. A exercise device as set forth in claim 1, said device including an adjustable foot support having means for selectively securing said support between said frame members along the length of said members, and said support presenting an elongated, flattened, rectangularly shaped, first section transversely oriented relative said frame members and an elongated, flattened, rectangularly shaped, second section having a width greater than that of the width of said first section, said first and second sections being pivotally interconnected adjacent respective longitudinal margins thereof, whereby said second section is selectively positionable overlying said first section in adjoining relationship.

3. An exercise device as set forth in claim 1, said weight-receiving unit comprising an elongated, cylindrical in cross-section, upwardly extending, weight-receiving bar, said bar presenting an elongated, upwardly angled, retention lug extending axially from said bar upper end.

4. A variable positioning mechanism for a weight-supporting device that is slidable on upwardly extending rails that have generally flat uppermost faces, said mechanism comprising:

a stop having an elongated weight supporting device engaging surface, said stop being fixedly secured to one of said rails and said engagement surface is oriented generally transverse to path of movement of a weight supporting device; and an elongated adjusting block presenting structure defining a plurality of generally parallel openings therein, said openings permit mounting said block on said rail's uppermost face by receiving said stop through one of said openings whereby said block is selectively positionable along said rails uppermost face.

5. A mechanism as set forth in claim 4, said block comprising a pair of spaced, elongated, generally parallel sideframes and a plurality of spaced-apart, elongated, generally parallel, support pieces transversely secured between said sideframes.

6. A mechanism as set forth in claim 4, said rail having side faces adjacent said uppermost face and said side frames each presenting a flattened plate, said plates interconnected at one end thereof by a flattened end plate, such that with said stop received in one of said openings said end plate engages said uppermost face and said side frames adjoin said rail side faces.

7. A weight-lifting device comprising:

a pair of elongated, spaced apart generally parallel, upwardly inclined rails each having a base end;

an elongated exercise unit operatively coupled adjacent each end thereof to said respective rails, said unit presenting elongated members oriented generally transversely between said rails;

an elongated, flattened, bench portion;

means on said unit member for releasably securing said bench portion to said unit member in a generally depending relationship therefrom, and for releasably securing said bench portion between said rail base ends with the longitudinal axis of said bench portion generally disposed in horizontal plane.

8. A weight-lifting device as set forth in claim 7, said unit including a pair of members each having a flattened face and said bench securing means including a pair of elongated, spaced-apart, generally parallel beams each having a flattened face, wherein said beam faces are spaced apart a distance such that said beams are removably secured to said members with said beam faces abutting respective member faces.

9. A weight-lifting device as set forth in claim 8, one of said beams being rectangular in cross-section presenting opposed first and second faces and its associated adjacent member having a channel structure for receiving said one of said beam, said channel structure presenting a flattened plate affixed to said adjacent member in a spaced generally parallel relationship, whereby said first face adjoins said plate and said second face adjoins said member.

10. An adjustable and movable foot support for use on a weight-supporting device, said foot support comprising:

a foot support assembly, including an elongated first plate presenting an upwardly facing foot-engaging first face;

an elongated second plate presenting a foot-engaging second face and located adjacent said first plate and with the longitudinal axis of the second plate generally parallel with the longitudinal axis of the first plate, the width of said second plate being greater than the width of said first plate; and means mounting said second plate in said location and for alternative positioning thereof between a lowered non-use position and a use position, in the use position the second plate is in covering relationship to said first plate and said second face is in an upwardly facing feet-engaging orientation; and means for coupling said assembly to a beam with the longitudinal axes of said first and second plates being transverse to the path of movement of said support assembly for releasably securing the assembly to support beam at any one of a number of spaced positions along the length of a beam.

11. An adjustable foot support as set forth in claim 10, said mounting means comprising a pivotal coupling adjacent respective lowermost margins of said first plate and said second plate.

12. An adjustable foot support as set forth in claim 10, said adjustable securement means comprising an elongated, flattened, mounting plate fixedly secured to said assembly and having an obliquely-oriented, depending arm secured to the lowermost face of said mounting plate, wherein said arm is complementally configured for sliding reception within slots within a supporting beam.

13. An exercise weight-supporting frame for supporting a movable weight-supporting:

a rigid base;

a weight-supporting assembly means for supporting the support device during the latter's movement on the frame, said assembly means including a pair of elongated, upwardly extending, laterally spaced-apart, generally parallel side frames each having a lower end and an upper end;

means for securing said lower ends of said side frames to said base; and means yieldably interconnecting the upper ends of said side frames including an elongated cross beam in generally spanning relationship to said side frames and having a pair of opposed ends; and structure means for coupling said opposed beam ends to corresponding adjacent side frames for permitting limited lateral movement of said side frames relative to said beam during an exercise, said coupling structure means comprising biasing means for restraining movement of said side frames in a direction away from said beam.

14. A weight-supporting frame as set forth in claim 13, said structure comprising a pair of apertured connection plates respectively secured adjacent said beam opposed ends, and an elongated shank secured to each of said side frames and slidingly extending through the aperture of the adjacent connection plate, said biasing means comprising a flexible coil spring disposed about each shank.

15. A weight supporting frame as set forth in claim 13, each of said side frames comprising a generally vertical strut, an obliquely-oriented side rail, and means interconnecting sad strut and side rail adjacent the upper ends thereof.

* * * * *